US011560899B2

(12) United States Patent
Miller et al.

(10) Patent No.: US 11,560,899 B2
(45) Date of Patent: Jan. 24, 2023

(54) PUMP WITH AXIALLY-ELONGATED ANNULAR SEAL ELEMENT BETWEEN INDUCER AND IMPELLER

(71) Applicant: Aerojet Rocketdyne, Inc., Sacramento, CA (US)

(72) Inventors: Jeff Miller, Simi Valley, CA (US); Steven Grota, Sacramento, CA (US)

(73) Assignee: AEROJET RICKETDYNE, INC., Canoga Park, CA (US)

( * ) Notice: Subject to any disclaimer, the term of this patent is extended or adjusted under 35 U.S.C. 154(b) by 0 days.

(21) Appl. No.: 17/282,395

(22) PCT Filed: Oct. 19, 2018

(86) PCT No.: PCT/US2018/056605

§ 371 (c)(1),
(2) Date: Apr. 2, 2021

(87) PCT Pub. No.: WO2020/081092

PCT Pub. Date: Apr. 23, 2020

(65) Prior Publication Data

US 2021/0340989 A1 Nov. 4, 2021

(51) Int. Cl.
*F04D 29/22* (2006.01)

(52) U.S. Cl.
CPC ..... *F04D 29/22* (2013.01)

(58) Field of Classification Search
CPC ..... F04D 29/22
See application file for complete search history.

(56) References Cited

U.S. PATENT DOCUMENTS 2,962,206 A * 11/1960 Borden ..... F04D 29/285 415/143
2,984,189 A * 5/1961 Jekat ..... F04D 29/186 415/74
4,097,186 A 6/1978 Burdis

FOREIGN PATENT DOCUMENTS

EP 0168603 1/1986

OTHER PUBLICATIONS

International Preliminary Report on Patentability for International Application No. PCT/US2018/056605 dated Apr. 14, 2021.
International Search Report & Written Opinion for International Application No. PCT/US2018/056605 completed Oct. 10, 2019.

* cited by examiner

*Primary Examiner* — Sabbir Hasan

(57) ABSTRACT

A pump includes a shaft that is rotatable about a central axis. An inducer is mounted on the shaft and has an inducer blade and inducer shroud attached at an outer end of the inducer blade. An impeller is mounted on the shaft downstream of the inducer and has an impeller blade and an impeller shroud attached at an outer end of the impeller blade. There is an axially-elongated annular seal element disposed at an axial end of the inducer shroud that provides sealing between the inducer shroud and the impeller shroud.

9 Claims, 2 Drawing Sheets

PUMP WITH AXIALLY-ELONGATED ANNULAR SEAL ELEMENT BETWEEN INDUCER AND IMPELLER

STATEMENT REGARDING FEDERALLY SPONSORED RESEARCH OR DEVELOPMENT

This invention was made with government support under contract number FA9300-07-C-0001 awarded by the United States Air Force. The government has certain rights in the invention.

BACKGROUND

Pumps are commonly known and used to pressurize fluids. For example, a centrifugal pump may include an inducer section and an impeller section. The inducer section initially raises the pressure of the fluid to a desired level prior to entry into the impeller section. The impeller section then serves to further boost the pressure of the fluid.

SUMMARY

A pump according to an example of the present disclosure includes a shaft rotatable about a central axis and an inducer mounted on the shaft. The inducer has an inducer blade and an inducer shroud attached at an outer end of the inducer blade. An impeller is mounted on the shaft downstream of the inducer. The impeller has an impeller blade and an impeller shroud attached at an outer end of the impeller blade. An axially-elongated annular seal element is disposed at an axial end of the inducer shroud providing sealing between the inducer shroud and the impeller shroud.

In a further embodiment of any of the foregoing embodiments, the inducer shroud has inside diameter surface that defines a passage through the inducer shroud, and the axially-elongated annular seal element is radially offset from the inside diameter surface.

In a further embodiment of any of the foregoing embodiments, the axially-elongated annular seal element defines an axial length and a radial thickness, and an aspect ratio of the axial length to the radial thickness is from 3 to 10.

In a further embodiment of any of the foregoing embodiments, the axially-elongated annular seal element projects axially from an enlarged base section on the inducer shroud to a free tip.

In a further embodiment of any of the foregoing embodiments, a distal portion of the axially-elongated annular seal element, including the free tip, is radially overlapping with the impeller shroud and a proximal portion of the axially-elongated annular seal element is non-overlapping with the impeller shroud.

In a further embodiment of any of the foregoing embodiments, an axial length of the distal portion that is overlapping with the impeller shroud is 25% or less of a total axial length of the axially-elongated annular seal element from the enlarged base to the free tip.

In a further embodiment of any of the foregoing embodiments, the axially-elongated annular seal element is in a flexed state such that a resiliency of the axially-elongated annular seal element provides a radial clamping force on the impeller shroud.

In a further embodiment of any of the foregoing embodiments, the axially-elongated annular seal element is formed of steel, titanium-based alloy, nickel-based alloy, aluminum, or composite.

In a further embodiment of any of the foregoing embodiments, the axially-elongated annular seal element is integral with the inducer shroud.

In a further embodiment of any of the foregoing embodiments, the inducer shroud includes a lip radially inwards of the axially-elongated annular seal element. The axially-elongated annular seal element and the lip define an axially-extending slot in a radial space there between.

In a further embodiment of any of the foregoing embodiments, the lip is spaced from an axial edge of the impeller shroud.

An inducer that is rotatable about a central axis according to an example of the present disclosure includes a rotatable inducer blade. An inducer shroud is attached at an outer end of the inducer blade, and an axially-elongated annular seal element is disposed at an axial end of the inducer shroud.

In a further embodiment of any of the foregoing embodiments, the inducer shroud has inside diameter surface that defines a passage through the inducer, and the axially-elongated annular seal element is radially offset from the inside diameter surface.

In a further embodiment of any of the foregoing embodiments, the axially-elongated annular seal element defines an axial length and a radial thickness, and an aspect ratio of the axial length to the radial thickness is from 3 to 10.

In a further embodiment of any of the foregoing embodiments, the axially-elongated annular seal element projects axially from an enlarged base section on the inducer shroud to a free tip.

In a further embodiment of any of the foregoing embodiments, the axially-elongated annular seal element is formed of steel, titanium-based alloy, nickel-based alloy, aluminum, or composite.

In a further embodiment of any of the foregoing embodiments, the axially-elongated annular seal element is integral with the inducer shroud.

In a further embodiment of any of the foregoing embodiments, the inducer shroud includes a lip radially inwards of the axially-elongated annular seal element. The axially-elongated annular seal element and the lip define an axially-extending slot in a radial space there between.

A method of assembling a pump according to an example of the present disclosure includes mounting an inducer and an impeller on a shaft that is rotatable about a central axis. The inducer has an inducer blade and an inducer shroud attached at an outer end of the inducer blade and the impeller has an impeller blade and an impeller shroud attached at an outer end of the impeller blade. Attaching the inducer shroud and the impeller shroud together using an axially-elongated annular seal element provides sealing between the inducer shroud and the impeller shroud.

In a further embodiment of any of the foregoing embodiments, the inducer shroud has an inside diameter surface that defines a passage through the inducer shroud. The axially-elongated annular seal element is radially offset from the inside diameter surface. The axially-elongated annular seal element defines an axial length and a radial thickness, and an aspect ratio of the axial length to the radial thickness is from 3 to 10.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
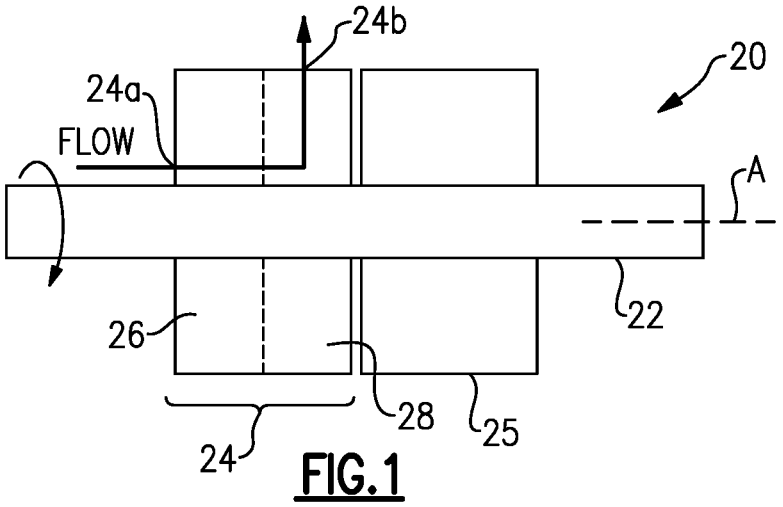
FIG. 1 illustrates an example pump.

FIG. 1 schematically illustrates selected portions of a pump 20. As an example, although not limited, the pump 20 is a turbopump. The pump 20 generally includes a shaft 22 that is rotatable about a central axis (A), a pump section 24 mounted for rotation on the shaft 22, and a turbine section 25 mounted on the shaft 22 adjacent the pump section 24. As an example, the turbine section 25 serves to rotate the shaft 22 and drive the pump section 24.

Figure 2:
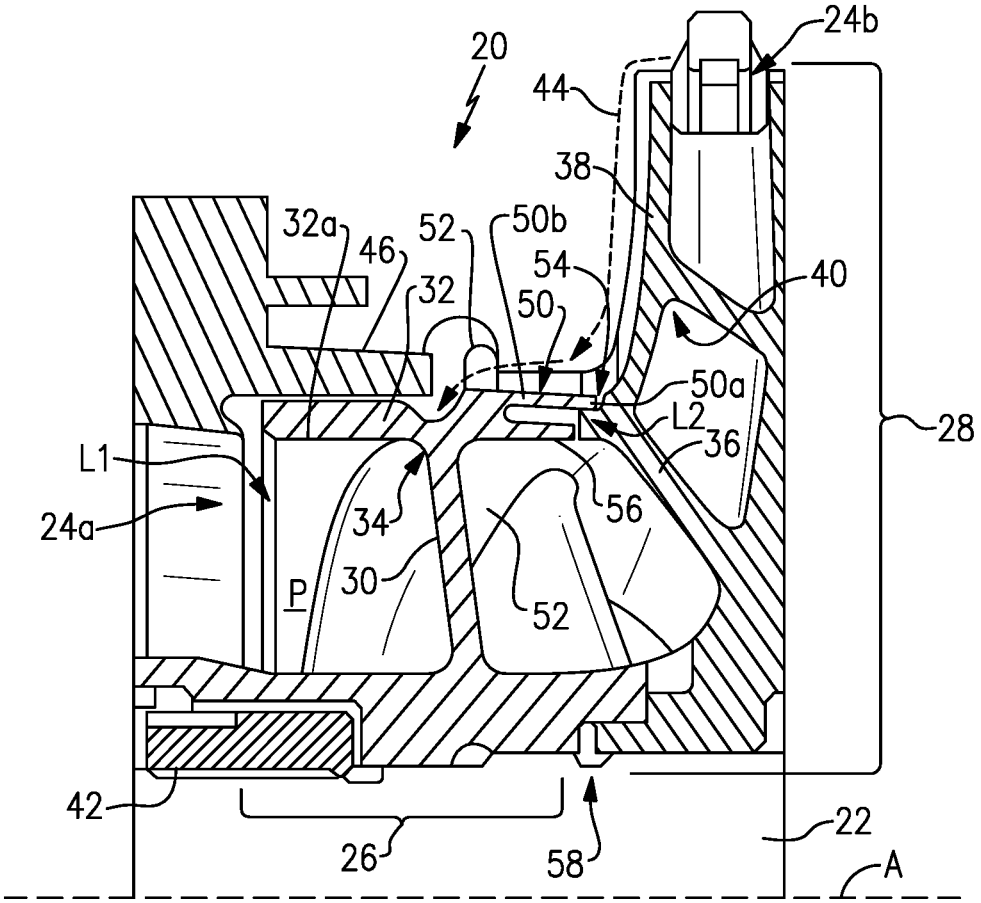
FIG. 2 illustrates a magnified view of selected portions of the pump of FIG. 1.

The pump section 24 intakes fluid through an axial inlet 24*a*, pressurizes the fluid, and discharges the pressurized fluid through a radial outlet 24*b*. The pump section 24 includes an inducer 26 and an impeller 28. The inducer 26 and the impeller 28 are shown in a magnified view in FIG. 2.

The inducer 26 is mounted on the shaft 22 and includes one or more inducer blades 30 and an inducer shroud 32 attached at an outer end 34 of the inducer blade or blades 30. In this case, the inducer 26 is axially arranged, and the outer end 34 of the blade or blades 30 is a radially outer end.

The impeller 28 is also mounted on the shaft 22 and includes one or more impeller blades 36 and an impeller shroud 38 attached at an outer end 40 of the impeller blade or blades 36. The inducer 26, including its blades 30 and shroud 32, and the impeller 28, including its blades 36 and shroud 38, co-rotate in unison with the shaft 22. In this regard, the inducer 26 and the impeller 28 may be secured on the shaft using a fastener 42.

The discharged fluid at the outlet 24*b* is at a relatively high pressure and can escape along a leak path 44 along the exterior of the shroud 38 to one or more locations that are upstream of the impeller 28. One such location may be between a damper seal 46 and the exterior or outside diameter of the shroud 32, represented at location L1. However, while such a backflow represents a pressure loss, the backflow at location L1 into the inducer 26 is generally desirable for damping purposes. Another potential location of backflow pressure loss can occur between the inducer 26 and the impeller 28, and more specifically, between the shrouds 32/38, represented at L2. Unlike the backflow at L1, the backflow at L2 is undesirable. In this regard, the pump 20 includes an axially-elongated annular seal element 50 that is disposed at an axial end 52 of the inducer shroud 32. The seal element 50 extends continuously around the central axis A and provides sealing between the inducer shroud 32 and the impeller shroud 38, even under dynamic conditions in which the shrouds 32/38 move relative to one another.

In this example, the seal element 50 projects axially from a base section 52 on the inducer shroud 32 to a free tip 54. In the region of the free tip 54, the seal element 50 is radially overlapping with the impeller shroud 38. For instance, the seal element 50 includes a distal portion 50*a*, which is farthest away from the base 52, and a proximal portion, which is closest to the base 52. The distal portion is the section of the seal element 50 that is overlapping with the impeller shroud 38. For example, relative to the total axial length of the seal element 50, the distal portion 50*a* is 25% or less of the total axial length.

The seal element 50 is relatively thin in radial thickness and relatively long in axial length. For example, the seal element 50 defines an axial length and a radial thickness, and an aspect ratio of the axial length to the radial thickness is from 3 to 10. Such an aspect ratio permits the seal element 50 to be resilient and flexible such that, via the resiliency, the seal element 50 provides a clamping force around and on the impeller shroud 38. The remainder of the inducer shroud 32 is thicker than the seal element 50 and thus provides a greater stiffness.

In the example shown, the seal element 50 is integral with the inducer shroud 32. That is, the seal element 50 and remaining portion of the shroud 32 are a single, monolithic piece. For example, the shroud 32, including the seal element 50, is formed of steel, titanium-based alloy, nickel-based alloy, aluminum, composite, etc.

The remaining portion of the shroud 32 adjacent the seal element 50 includes an inside diameter surface 32*a* that defines a passage P through the inducer 26. In general, the inside diameter surface 32*a* is cylindrical. The seal element 50 is radially offset from the inside diameter surface 32*a*. In this case, the seal element 50 is offset radially outward of the inside diameter surface 32*a*. Such an offset leaves a radial space or gap inward of the seal element 50. If such a gap is unacceptable with regard to flow through the inducer 26, the shroud 32 can be provided with a lip 56 radially inward of the seal element 50. For example, the lip 56 extends axially and is spaced radially inward from the seal element 50 such that the seal element 50 and the lip 56 define an axially-extending slot in the radial space there between. In this example, the distal or axial end of the lip 56 may be near the impeller shroud 38 but is spaced from the impeller shroud 38.

As alluded to above, although the shrouds 32/38 co-rotate, the shrouds 32/38 may move relative to one another due to thermal expansions/contractions, mechanical distortions from rotation, or other forces during operation. If there is any mismatch in the distortions between the shrouds 32/38, a leak path may open for the backflow of the discharge pressure along the path 44. However, due to its flexibility and resiliency, the seal element 50 maintains the clamping force on the impeller shroud 38 and thereby maintains sealing under such conditions. In this regard, the seal element 50 is configured to be flexible and resilient under the operational forces of the pump 20.

Figure 3:
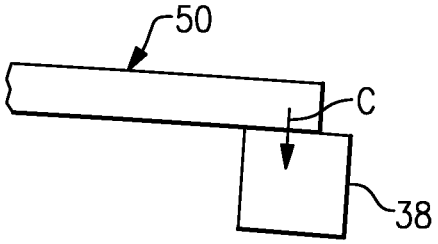
FIG. 3 illustrates a seal element sealing against a shroud under a baseline condition.

For example, as shown schematically in FIG. 3, when there is no distortion in either of the shrouds 32/38, the seal element 50 is resiliently biased to provide a clamping force, represented at C against the surface of the impeller shroud 38. The clamping force maintains a tight seal around the shroud 38 to reduce or prevent leakage from the path 44 into the inducer 26 or impeller 28 upstream of the outlet 24*b*.

Figure 4:
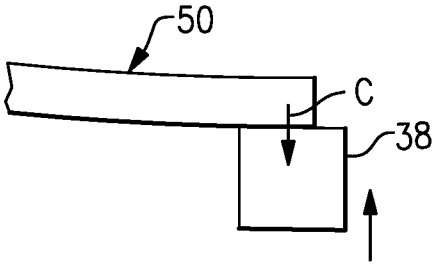
FIG. 4 illustrates the seal element sealing against the shroud under a first state of distortion.
Figure 5:
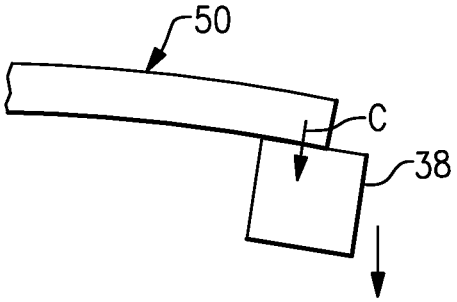
FIG. 5 illustrates the seal element sealing against the shroud under a second state of distortion.

In FIG. 4, there is a relative distortion between the shrouds 32/38, which is represented by the upward vertical movement of the shroud 38 in the figure. Since the seal element 50 is flexible and resilient, it bends to accommodate the movement while maintaining the clamping force C on the surface of the shroud 38 and thereby maintaining sealing. Similarly, FIG. 5 depicts the opposite scenario in which distortion has caused the shroud 38 to move vertically downward in the figure. In this case, again since the seal element 50 is flexible and resilient, the seal element 50 bends to maintain contact with the surface of the shroud 38 and continue to apply the clamping force C to maintain sealing. Thus, when the pump 20 is operating, the seal element 50 is in a flexed state such that the resiliency continually provides a clamping force on the impeller shroud 38 to maintain sealing against the surface of the shroud 38. For instance, the flexibility and resiliency may be obtained by the aspect ratio and percent overlap discussed above. If a seal element were to have an aspect ratio that were very small and/or a high degree of overlap, the seal element may be too stiff to properly move with the operation distortions. On the other hand, if a seal element were to have an aspect ratio that were very large and/or an overlap that was very small, it may lift off of the shroud 38 under circumferential forces.

The flexibility and resiliency of the seal element 50 may also isolate the damper seal 46 from relative differences in distortion between the shrouds 32/38. For instance, the seal element 50, by bending to accommodate the relative differences in distortions between the shrouds 32/38, in essence acts as a buffer so that such differences in distortions are not conveyed to the damper seal 46. For example, but for the seal element 50, a relative distortion between the shrouds 32/38 would cause distortion of the shroud 32 in the vicinity of the damper element 46 and temporarily convert the seal damper 46 from a convergent damping seal to a divergent damping seal, which is undesirable. However, with the seal element 50 absorbing much of the relative difference in distortion between the shrouds 32/38, the shroud 32 experiences less or no distortion and is thus maintained as a convergent damping seal.

In addition, if the impeller shroud 38 includes scalloping, the flexibility and resiliency of the seal element 50 may further allow the seal element 50 to follow the scalloping in the tangential direction between the blades 36.

The pump 20 may also embody a method of assembly, which may be conducted in connection with an original fabrication of the pump 20 or in connection with a repair or refurbishment process in which the pump is disassembled and then later reassembled. The method may include mounting the inducer 26 and the impeller 28 on the shaft 22. For instance, in an original fabrication, the mounting may include sliding the inducer 26 and the impeller 28 onto the shaft 22 and then securing the inducer 26 and the impeller 28 in place using the fastener 42. In another example, in a repair scenario, the mounting may include sliding one or the other of the inducer 26 or the impeller 28 onto the shaft 22 and then securing the inducer 26 and the impeller 28 in place using the fastener 42. The method further includes attaching the inducer shroud 32 and the impeller shroud 38 together using the axially-elongated annular seal element 50, to provide sealing between the inducer shroud 32 and the impeller shroud 38. Such attaching may include bringing the inducer 26 and the impeller 28 together such that the impeller shroud 38 is received into the annulus defined by the seal element 50. The attaching may further include bringing the inducer 26 and the impeller 28 together such that the impeller 28 is received into the pilot 58 and the inducer 26 and the impeller 28 are coaxially aligned.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A pump comprising:

a shaft rotatable about a central axis;

an inducer mounted on the shaft, the inducer having an inducer blade and an inducer shroud attached at an outer end of the inducer blade;

an impeller mounted on the shaft downstream of the inducer, the impeller having an impeller blade and an impeller shroud attached at an outer end of the impeller blade;

an axially-elongated annular seal element disposed at an axial end of the inducer shroud providing sealing between the inducer shroud and the impeller shroud, the axially-elongated annular seal element is in a flexed state such that a resiliency of the axially-elongated annular seal element provides a radial clamping force on the impeller shroud, the axially-elongated annular seal element defines an axial length and a radial thickness, and an aspect ratio of the axial length to the radial thickness is from 3 to 10.

2. The pump as recited in claim 1, wherein the inducer shroud has an inside diameter surface that defines a passage through the inducer shroud, and the axially-elongated annular seal element is radially offset from the inside diameter surface.

3. The pump as recited in claim 1, wherein the axially-elongated annular seal element projects axially from an enlarged base section on the inducer shroud to a free tip.

4. The pump as recited in claim 3, wherein a distal portion of the axially-elongated annular seal element, including the free tip, is radially overlapping with the impeller shroud and a proximal portion of the axially-elongated annular seal element is non-overlapping with the impeller shroud.

5. The pump as recited in claim 4, wherein an axial length of the distal portion that is overlapping with the impeller shroud is 25% or less of a total axial length of the axially-elongated annular seal element from the enlarged base to the free tip.

6. The pump as recited in claim 1, wherein the axially-elongated annular seal element is formed of steel, titanium-based alloy, nickel-based alloy, aluminum, or composite.

7. The pump as recited in claim 1, wherein the axially-elongated annular seal element is integral with the inducer shroud.

8. The pump as recited in claim 1, wherein the inducer shroud includes a lip radially inwards of the axially-elongated annular seal element, the axially-elongated annular seal element and the lip defining an axially-extending slot in a radial space there between.

9. The pump as recited in claim 8, wherein the lip is spaced from an axial edge of the impeller shroud.

* * * * *